US005516316A

United States Patent [19]

Rumminger

[11] Patent Number: 5,516,316

[45] Date of Patent: May 14, 1996

[54] DIVER AWARENESS BUOY

[76] Inventor: Kenneth S. Rumminger, 154 Green Vista La., Greenville, S.C. 29609

[21] Appl. No.: 380,017

[22] Filed: Jan. 27, 1995

[51] Int. Cl.[6] ..... B63B 22/00

[52] U.S. Cl. ..... 441/1; 441/6; 441/28

[58] Field of Search ..... 441/1, 6, 7, 11, 441/28, 30; D12/316; 114/315

[56] References Cited

U.S. PATENT DOCUMENTS 1,558,200 10/1925 Murphy .
1,632,356 6/1927 Weimer .
2,368,834 2/1945 Higgins ..... 441/1
3,149,352 9/1964 Christiansen .
5,096,448 3/1992 Grey et al. ..... 441/6
5,360,359 11/1994 Reynolds ..... 441/6

*Primary Examiner*—Stephen Avila
*Attorney, Agent, or Firm*—Gerald R. Boss; Cort Flint

[57] ABSTRACT

A diver awareness buoy for signaling the presence of scuba divers diving underwater within a general diving area including a base and an inflatable bladder having a main body. The main body has a humanoid configuration including a torso section and a head section simulating the upper body of a scuba diver present in water. The torso section includes torso indicia corresponding to the signal for signaling that a scuba diver is beneath the water surface. A ballast is carried by the inflatable bladder for maintaining the buoy in an upright floating position in water.

17 Claims, 4 Drawing Sheets

64
68
64
66
40
38
22
31
28
30
24
29
20
26
27
36
A
34
18
14
DIVER
8
42
10
11
12
54
13
16
44
52
15
56
58

DIVER AWARENESS BUOY

BACKGROUND OF THE INVENTION

This invention relates to a buoy for indicating the presence of a scuba diver diving underwater, and more particularly to a diver awareness buoy having an inflatable bladder resembling the upper portion of a scuba diver. Dive flags are used by scuba divers and skin divers to identify to surface vehicles such as boats that persons are diving underwater within the general area around the dive flag. A standard dive flag includes a diagonal white stripe against a red background. These flags are generally placed in a buoyant member such as an innertube for keeping the dive flag above the water and visible to boats and the like. U.S. Pat. No. 3,149,352 illustrates an inflatable diver's flag.

However, it frequently occurs that boats disregard the flags and pass through the area where divers are diving. This may occur because either the driver of the boat does not see the flag, does not comprehend the meaning associated with the flag, or assumes that the divers are below underwater and not near the surface. The presence of boats passing through the area where divers are diving presents a hazardous environment to the divers.

Other forms of inflatable water objects include an aquatic doll disclosed in U.S. Pat. No. 1,558,200 designed to float in an upright position when placed in the water for the amusement of children while bathing. Also, an inflatable toy is disclosed in U. S. Pat. No. 1,632,356. These dolls are not intended to be used as buoys or for signaling the presence of divers diving in a general area.

Accordingly, a need arises to effectively alert driver's of boats to the presence of scuba divers.

Accordingly, an object of the present invention is to provide a diver awareness buoy which signals to boats the presence of divers diving in the general vicinity.

Yet another object of the present invention is to provide a diver awareness buoy resembling a diver for signaling the presence of divers to boats.

Another object of the present invention is to provide a diver awareness buoy which is easy to manufacture.

SUMMARY OF THE INVENTION

The above objectives are accomplished according to the present invention by providing a diver awareness buoy for signaling the presence of scuba divers diving underwater within a general diving area. The diver awareness buoy includes an inflatable bladder having a main body. Upon inflation, the main body extends into an upright position. The main body has a humanoid configuration including a torso section and a head section simulating the upper body of a scuba diver present in water. The torso section includes torso indicia corresponding to a signal for signaling that a scuba diver is beneath the water surface.

For flotation, the buoy has a predetermined width providing sufficient displacement of water for maintaining the buoy upright when placed in water. A ballast is carried by the buoy for maintaining the buoy in an upright floating position in water.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
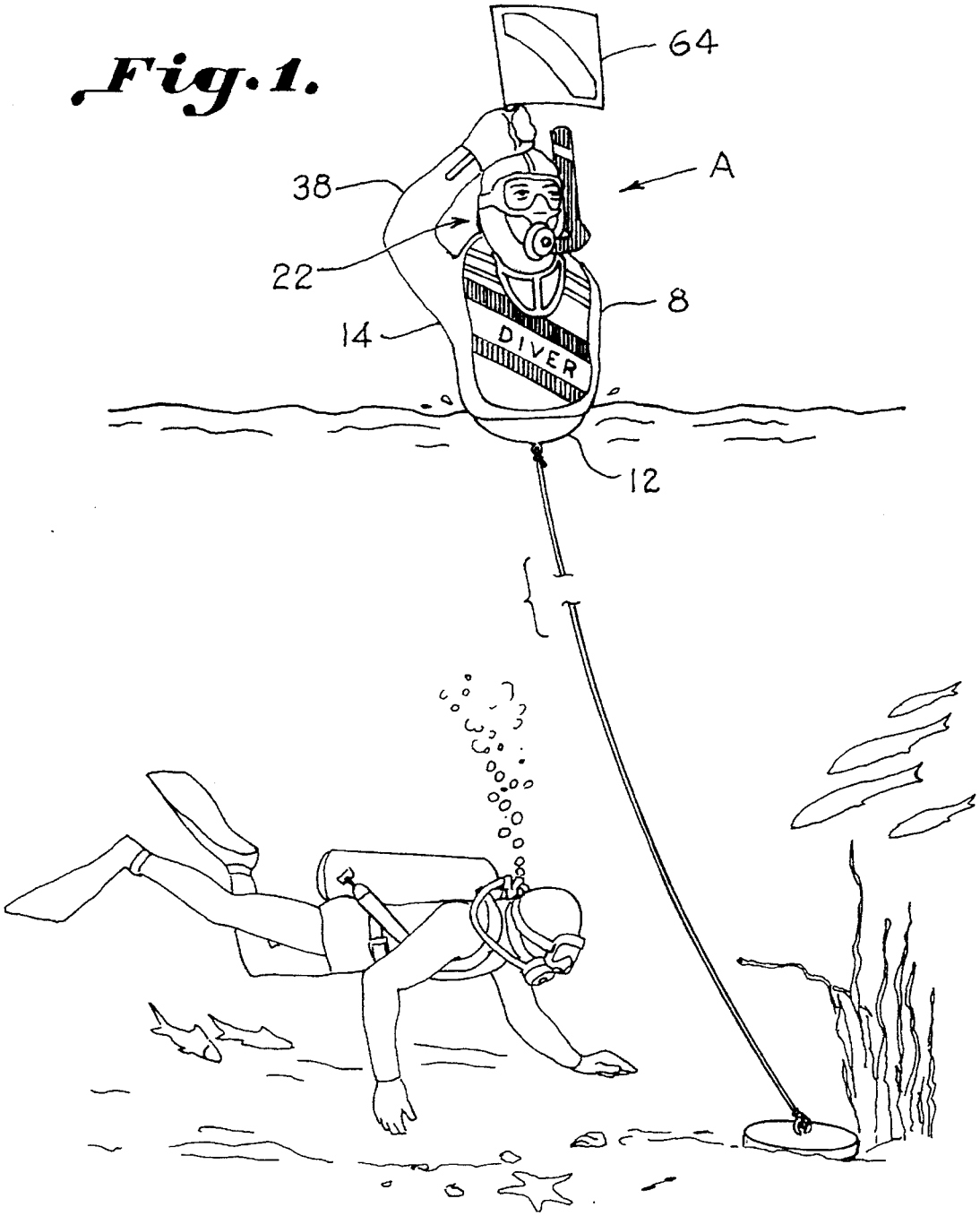
FIG. 1 is a perspective view of a diver awareness buoy according to the invention used in association with a scuba diver diving underwater.

As shown in FIG. 1, a diver awareness buoy A is positioned in the water for signaling the presence of scuba divers diving underwater within a general diving area. Diver awareness buoy A resembles the upper torso of a scuba diver and floats upright when positioned in the water. From a distance, diver awareness buoy A simulates an actual human in the water, thus affecting driver of boats to steer around the buoy for fear of striking a human.

Figure 2:
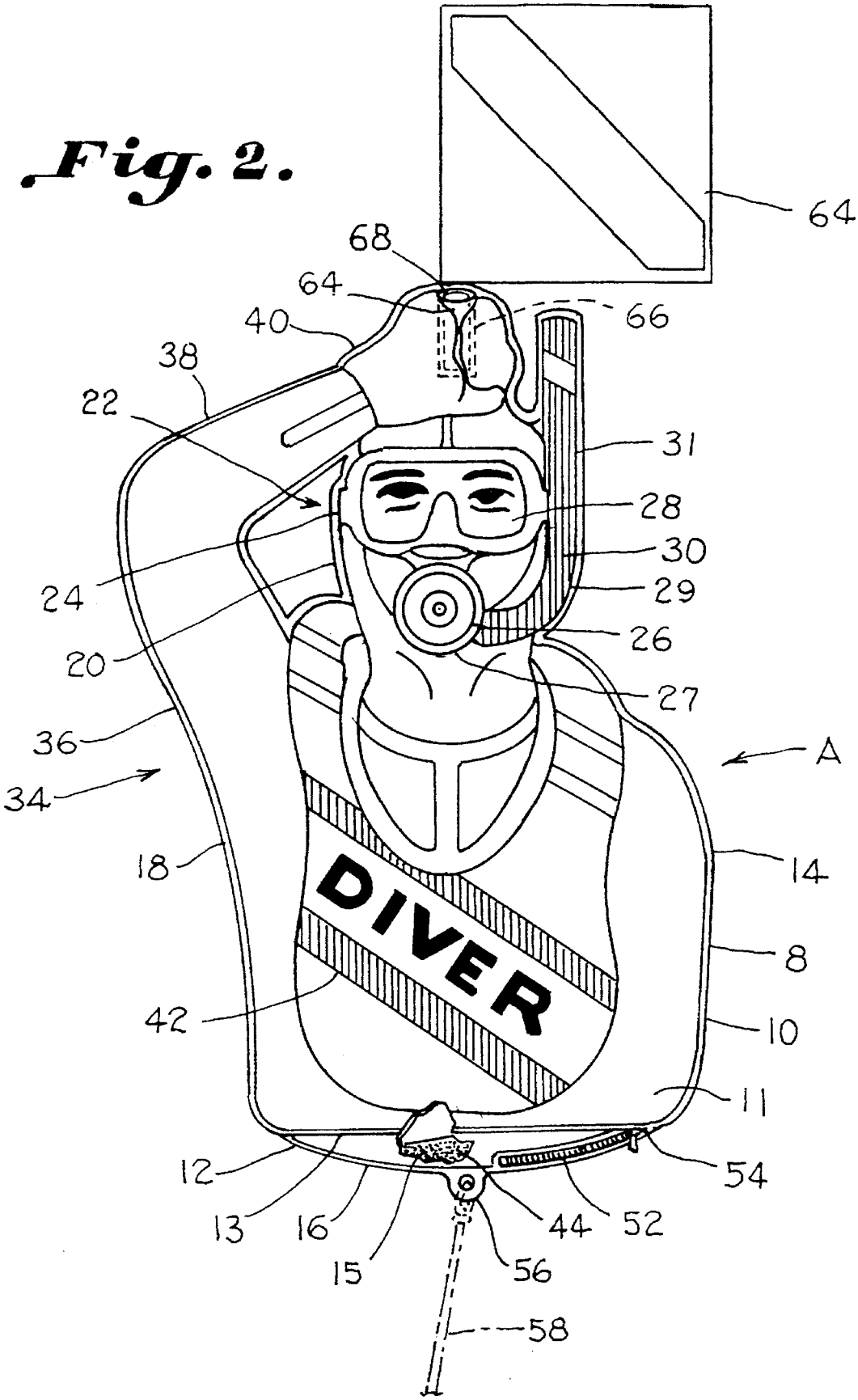
FIG. 2 is a front view of a diver awareness buoy according to the invention.
Figure 3:
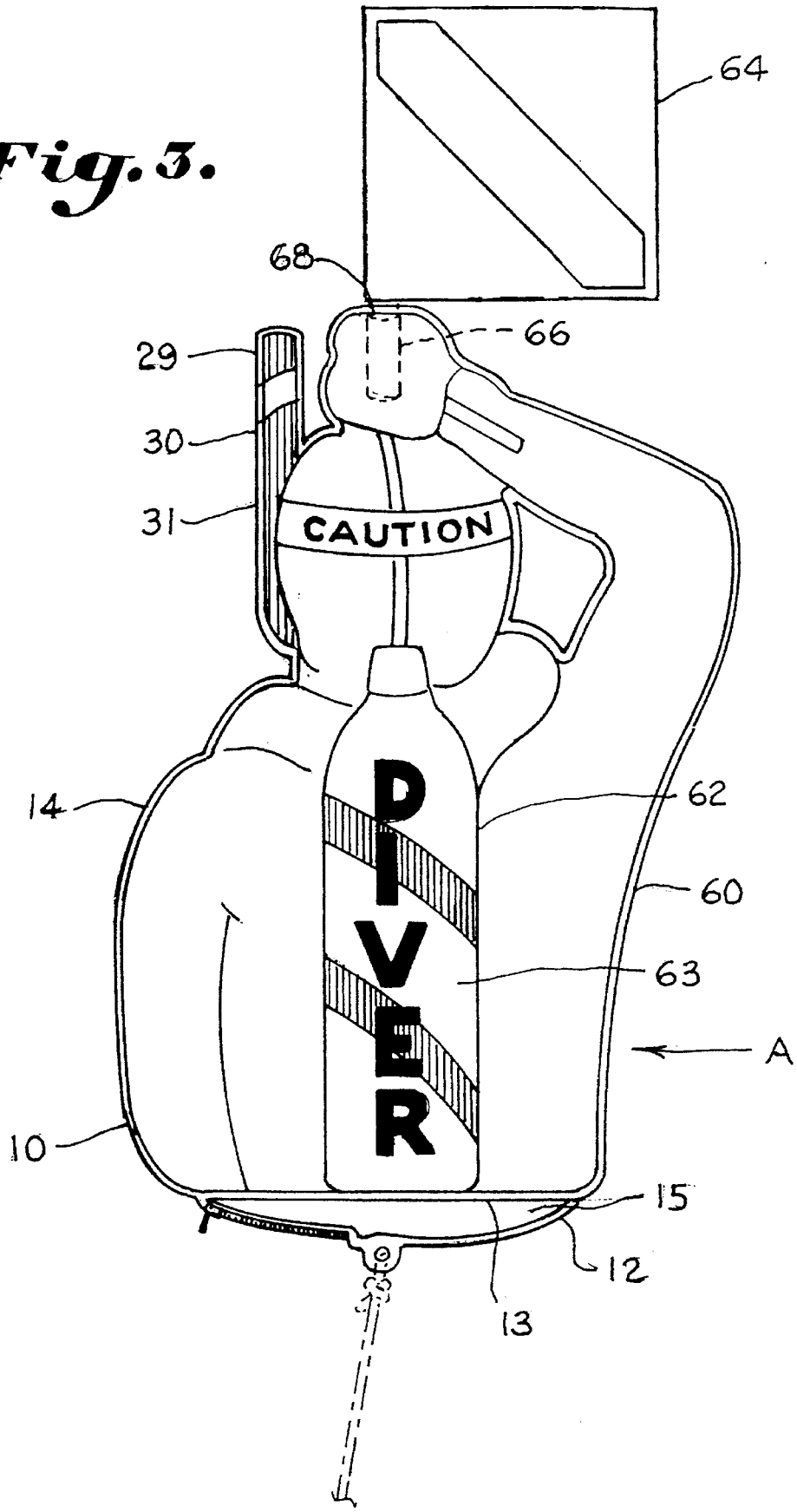
FIG. 3 is a back view of a diver awareness buoy according to the invention.
Figure 4:
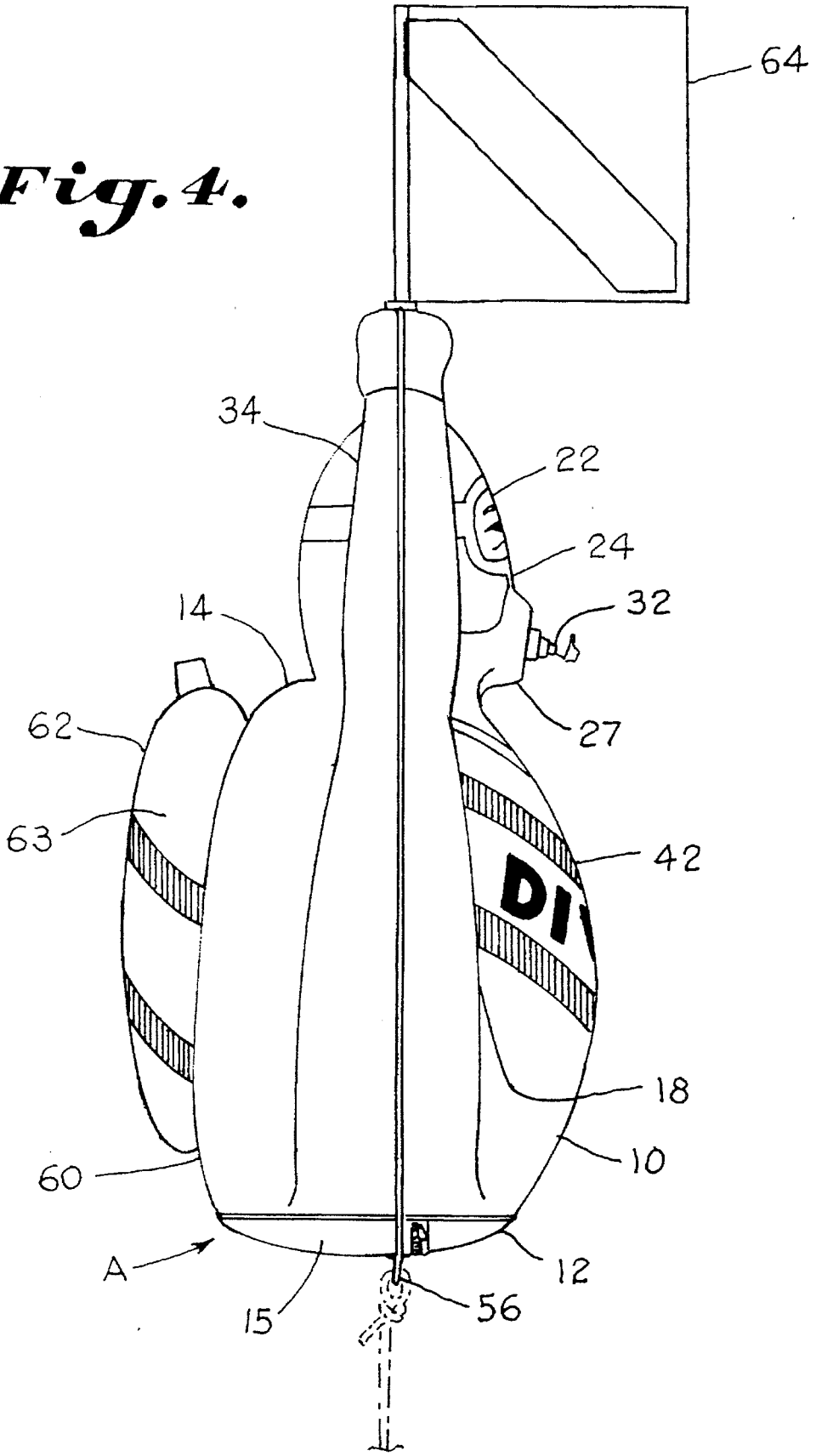
FIG. 4 is a side view of a diver awareness buoy according to the invention.

As shown in FIGS. 2, 3, and 4 diver awareness buoy A consists of a buoyant member 8 for floating in water. Buoyant member 8 may be made from styrofoam or the like. In the preferred embodiment, buoyant member 8 is made from an inflatable bladder 10 which has an interior inflation chamber 11. Buoy A may be made from vinyl or other flexible material and is capable of being folded into a compact package for transport by a diver. Inflatable bladder 10 has main body 14 which extends into an upright position when inflated. Base 12 is carried by inflatable bladder 10. In the preferred embodiment, inflatable bladder 10 and base 12 are molded as a unitary vinyl piece.

The bottom of interior inflation chamber 11 may be formed by base 12. In the preferred embodiment, interior bottom wall 13 defines the bottom of interior inflation chamber 11 and base 12 is spaced from interior bottom wall 13 to define ballast receptacle 15. Base 12 has a predetermined width providing sufficient displacement of water for maintaining bladder 10 upright when placed in water. In the preferred embodiment, base 12 is approximately twenty-three inches across having a convex configuration having rounded hull shaped portion 16 for displacing water.

Main body 14 has a human configuration simulating the upper body of a scuba diver present in the water. Main body 14 includes torso section 18 and head section 20. Head section 20 includes indicia 22 embodied on head section 20 corresponding to the head of a scuba diver. Indicia 22 includes scuba mask indicia 24 resembling a scuba mask, scuba regulator indicia 26 resembling a scuba regulator and face indicia 28 resembling a human face within scuba mask indicia 24 for resembling a human head. In the preferred embodiment, scuba regulator indicia 26 consists of inflatable regulator chamber 27 which extends outward from body 14 when inflated and contains markings resembling a scuba regulator.

In the preferred embodiment, inflatable regulator chamber 27 is in fluid communication with interior inflation chamber 11 enabling inflatable regulator chamber 27 and inflatable bladder 10 to be inflated through one inflator port. Also, elongated snorkel section 29 consisting of an inflatable snorkel chamber 30 is in fluid communication with inflatable regulator chamber 27. Snorkel section 29 extends generally horizontally away from inflatable regulator chamber 27 to a predetermined distance and extends upward at an angle generally parallel to head section 20. Snorkel section 29 includes snorkel indicia 31 having a diagonal white stripe on a red background corresponding to the international signal for signaling that a scuba diver is diving beneath the water surface.

As shown in FIG. 4, inflator 32 for transferring air into bladder 10 for inflating bladder 10 may be received by bladder 10 at any location. In the preferred embodiment, inflator 32 is received by regulator chamber 27 to resemble the purge button of a standard regulator.

In the preferred embodiment, torso section 18 includes arm section 34. Arm section 34 includes upper arm 36 which extends upwardly from torso section 18 at a first angle. Upper arm 36 terminates at forearm 38. Forearm 38 extends upwardly away from upper arm 36 at an elbow at a second angle. Forearm 38 terminates at hand 40. Hand 40 terminates atop head section 20. The configuration of upper arm 36, forearm 38 and hand 40 corresponds to an international signal representing that a scuba diver is in a satisfactory condition. The addition of arm section 34 enhances the visibility of diver awareness buoy A by creating a large profile which may be seen when viewed from a distance.

Also in the preferred embodiment, torso section 18 includes torso indicia 42 having a diagonal white stripe on a red background corresponding to the international signal for signaling that a scuba diver is beneath the water surface. Torso indicia 42 may also include a yellow background resembling a diver's vest.

Ballast 44 is carried by base 12 for maintaining bladder 10 in an upright floating position when in the water. Ballast 44 may be any suitable weighted object including sand or water. In the preferred embodiment, ballast receptacle 15 receives ballast 44. Base 12 defines ballast opening 52 which leads into ballast receptacle 15. Closing means 54, which may be a zipper, opens and closes ballast opening 52 providing access to ballast receptacle 15. Base 12 also includes anchor tie 56 for receiving tethering line 58 for securing diver awareness buoy A in place in the water.

As shown in FIGS. 3 and 4 main body 14 includes a back section 60. Back section 60 includes scuba tank indicia 62 resembling a scuba tank worn by a scuba diver for representing a scuba diver when viewed from behind. In the preferred embodiment, scuba tank indicia 62 includes an inflatable vertical chamber 63 in fluid communication with interior inflation chamber 11 formed to resemble a scuba tank.

As shown in FIGS. 1, 2, 3, and 4 dive flag 64 is carried by diver awareness buoy A for enhancing the visibility of buoy A while buoy A floats in the general diving area. Dive flag 64 may be affixed to main body 14 by any suitable dive flag holder such as velcro or the like. In the preferred embodiment as shown in FIG. 2, dive flag holder 66 consists of insert bore 68 received within head section 20 and which passes through hand 40 having an insert 69 which may be tubular. Insert bore 68 receives a pole of dive flag 64. Dive flag 64 may be any standard dive flag and typically includes a white diagonal stripe against a red background corresponding to the international signal that a diver is diving beneath the water. For international models, dive flag 64 will include the international symbol for signaling divers diving in the general area. The international dive flag consists of a white and blue pennant.

While a preferred embodiment of the invention has been described using specific terms, such description is for illustrative purposes only, and it is to be understood that changes and variations may be made without departing from the spirit or scope of the following claims.

What is claimed is:

1. A diver awareness buoy for signaling the presence of scuba divers diving underwater within a general diving area, said buoy comprising:

a buoyant member having an elongated main body;

a base carried by said main body having a predetermined width providing sufficient displacement of water for maintaining said main body in an upright position when placed in water;

a torso section resembling the torso of a scuba diver included in said main body;

a head section resembling the head of a scuba diver carried atop an upper portion of said torso section;

said torso chamber and head chamber of said main body having a human configuration simulating the upper body of a scuba diver which are visible above the water when said main body is in said upright position in the water presenting an appearance of a human scuba diver afloat when said buoyant main body is afloat;

a dive flag carried by said buoyant member corresponding to the signal for signaling a diver is diving underwater; and a ballast carried by said base for maintaining said buoyant member in said upright when afloat in water.

2. The diver buoy of claim 1 wherein said dive flag includes torso indicia embodied on said torso section corresponding to the signal for signaling a diver is diving underwater.

3. The diver buoy of claim 1 wherein said torso section includes an arm section extending outwardly from said torso section and said arm section terminating atop of said head section in a configuration corresponding to an international sign representing that a scuba diver is in a satisfactory condition.

4. The diver buoy of claim 3 wherein said arm section includes an upper arm extending upwardly from said torso section at a first angle, said upper arm terminating at a forearm, said forearm extending upwardly from said upper arm portion at a second angle, said forearm portion terminating at a hand, said hand terminating atop of said head section in a configuration corresponding to an international sign representing that a scuba diver is in a satisfactory condition.

5. The diver buoy of claim 1 including a dive flag holder carried by said main body for affixing said dive flag to said main body in an upright position enhancing the visibility of said buoy while said buoy floats in said general diving area.

6. The diver buoy of claim 5 wherein said main body includes an insert bore defining said dive flag holder for receiving a pole of said dive flag.

7. The diver buoy of claim 1 wherein said head section corresponds to the head of a scuba diver including scuba mask indicia resembling a scuba mask and scuba regulator indicia resembling a scuba regulator.

8. The diver buoy of claim 1 wherein said base includes a convex configuration having a rounded hull shaped portion displacing water to facilitate maintaining said buoy in an upright floating position in water.

9. The diver buoy of claim 1 including an anchor tie carried by said base for receiving a tethering line for securing said diver buoy in place.

10. The diver buoy of claim 1 wherein said main body includes a back section, said back section carrying scuba tank indicia resembling a scuba tank worn by scuba divers.

11. A diver awareness buoy for signaling the presence of scuba divers diving underwater within a general diving area, said buoy comprising:

an inflatable bladder capable of being folded into a compact package for transport by a diver;

said inflatable bladder having a main body extending into an upright position when inflated;

a base carried by said inflatable bladder having a predetermined width providing sufficient displacement of water for maintaining said inflatable bladder upright when placed in water;

an inflatable torso section resembling the torso of a scuba diver included in said main body;

an inflatable head section resembling the head of a scuba diver carried atop an upper portion of said torso section;

said inflatable torso chamber and head chamber of said main body having a human configuration simulating the upper body of a scuba diver which are visible above the water when said main body is in said upright position in the water presenting an appearance of a human scuba diver afloat when said buoyant main body is afloat;

a dive flag holder carried by said main body for affixing a dive flag to said main body in an upright position enhancing the visibility of said buoy while said buoy floats in said general diving area; and a ballast carried by said base for maintaining said inflatable bladder in an upright floating position in water.

12. The diver buoy of claim 11 wherein said main body includes an insert bore defining said dive flag holder for receiving a pole of a dive flag.

13. The diver buoy of claim 11 wherein said base includes a convex configuration having a rounded hull shaped portion displacing water to facilitate maintaining said buoy in an upright floating position in water.

14. The diver buoy of claim 11 wherein said bladder includes an interior bottom wall spaced from said base to define a ballast receptacle for receiving said ballast, said base defining a ballast opening leading into said ballast receptacle.

15. The diver buoy of claim 14 including a closing means carried by said base for opening and closing said ballast opening.

16. The diver buoy of claim 11 including an anchor tie carried by said base for receiving a tethering line for securing said diver buoy in place.

17. The diver buoy of claim 11 wherein said scuba tank indicia includes an inflatable vertical tank carried by said back section.

* * * * *